US005645095A

United States Patent [19]

Ramonowski

[11] Patent Number: 5,645,095

[45] Date of Patent: Jul. 8, 1997

[54] LOW FRICTION CRUTCH PAD COVER

[76] Inventor: Roland Ramonowski, 1320 4th Ave., Schenectady, N.Y. 12303

[21] Appl. No.: 733,026

[22] Filed: Oct. 16, 1996

[51] Int. Cl.[6] ..... A61H 3/02

[52] U.S. Cl. ..... 135/68; 135/73

[58] Field of Search ..... 135/68, 73, 72, 135/76

[56] References Cited

U.S. PATENT DOCUMENTS

| | | | |
|---|---|---|---|
| 1,906,264 | 5/1933 | Higgins | 135/73 |
| 1,957,473 | 5/1934 | Pirtle et al. | 135/73 |
| 2,856,943 | 10/1958 | Sparlin . | |
| 3,269,400 | 8/1966 | Smith et al. . | |
| 3,858,596 | 1/1975 | Thomas . | |
| 5,078,640 | 1/1992 | Berman . | |
| 5,101,846 | 4/1992 | Greatwood . | |

FOREIGN PATENT DOCUMENTS

| | | | |
|---|---|---|---|
| 1167616 | 6/1918 | United Kingdom | 135/73 |

*Primary Examiner*—Lanna Mai

*Attorney, Agent, or Firm*—Schmeiser, Olsen & Watts

[57] ABSTRACT

A waterproof, stain proof and nonporous crutch pad cover formed out of a material having a low coefficient of friction. The crutch pad cover includes an elongate slotted body member having first and second sides which are adapted to partially encircle the periphery of a crutch pad along a portion of its length, a first end portion having an inwardly directed flanged end section which is adapted to enclose a first end of the crutch pad and a second end portion which is adapted to cover a second, opposite end of the crutch pad. A flap securing system is utilized to secure the first and second sides of the body member about the crutch pad proximate the second end thereof. A plurality of outwardly projecting stop members positioned proximate the first and second end portions of the body member are provided to prevent the under arm area of a crutch user from slipping off the low friction crutch pad cover.

11 Claims, 1 Drawing Sheet

LOW FRICTION CRUTCH PAD COVER

FIELD OF THE INVENTION

The present invention relates to crutch pad covers and, more particularly, to an elongate slotted crutch pad cover formed out of a material having a low coefficient of friction. The crutch pad cover includes a body member having first and second sides which are adapted to partially encircle the periphery of a crutch pad along a portion of its length, a first end portion having an inwardly directed flanged end section which is adapted to enclose a first end of the crutch pad and a second end portion which is adapted to cover a second, opposite end of the crutch pad. A flap securing system which utilizes a tab/aperture system, loop/hook-type material or other appropriate type of fastening system may be utilized to secure the first and second sides of the body member about the underside of the crutch arm piece proximate the second end of the crutch pad. To ensure that the underarm area of a crutch user does not slip off the low friction crutch pad cover of the present invention, a plurality of outwardly projecting stop members may be positioned proximate the first and second end portions thereof.

BACKGROUND OF THE INVENTION

When recovering from a broken leg, a sprained knee or ankle, a hip replacement or any of a myriad of additional injuries or medical procedures, it is often necessary to avoid placing an undue amount of pressure on the affected section of the body during the recuperative process. Consequently, supportive devices such as a wheelchair, a cane, a walker, or most commonly, a pair of crutches, are typically utilized to reduce or substantially eliminate the amount of pressure applied to the recovering area of the body.

A crutch, which is typically formed from wood or metal components, generally includes a pair of upwardly directed bows which are adjustably fastened proximate a lower section thereof to opposing sides of a rubber-tipped footpiece, a cushioned handpiece which is adjustably and symmetrically secured between an opposing intermediate section of each upwardly directed bow, and an arm piece which bridges the upper end of each bow. To reduce the underarm, shoulder and/or other upper body discomfort commonly associated with the prolonged utilization of crutches, a removable cushioning foam rubber crutch pad may be secured over the arm piece of each crutch.

When a pair of crutches are utilized as designed, a crutch user should grasp the handpiece on each crutch and support the majority of his or her body weight with the arms. However, due to arm fatigue, a low energy level, laziness and/or other factors, crutch users tend to support most of their body weight on the arm pieces of the crutch. Consequently, the crutch pads which cover the crutch arm pieces must be specifically designed to lessen the discomfort associated with the above-described improper crutch operation. Unfortunately, currently available foam rubber crutch pads suffer from a plurality of disadvantages which limit their operational comfort, life span and appearance and which have a negative impact upon the clothing of a user.

The foam rubber which is generally utilized to form crutch pads typically has a large coefficient of friction. As a result, the crutch pads tend to abrade the section of a crutch user's clothing proximate the underarm area thereof, thereby potentially damaging the clothing material. In addition, the underarm area of the clothing may bunch up on the crutch pad, thereby wrinkling the material or resulting in the pinching, irritation and/or chafing of the underlying skin.

The commonly available foam rubber crutch pads also tend to collect and absorb a large amount of dirt, moisture, perspiration and/or odors, are difficult to clean and must be frequently replaced because of the high porosity of the foam rubber. In addition, the foam rubber crutch pads have a propensity to crack, harden and break apart after being repeatedly exposed to moisture, thereby acquiring a ragged appearance.

SUMMARY OF THE INVENTION

In order to avoid the disadvantages of the prior art, the present invention utilizes a crutch pad cover formed out of a nonporous, waterproof and stain resistant material having a low coefficient of friction.

The crutch pad cover, which is designed to fit over an existing crutch pad, includes an elongate slotted body member having first and second sides which are adapted to partially encircle the periphery of a crutch pad substantially along its entire length. In particular, the first and second sides form an elongate slot on the underside of the body member which is utilized during the attachment and removal of the crutch pad cover. The elongate slotted body member also includes a first end portion having an inwardly directed flanged end section which forms a continuous cavity for receiving a first end of a crutch pad therein, and a downwardly directed second end portion for covering a second, opposite end of the crutch pad.

The crutch pad cover also includes a flap securing system for removably or fixedly fastening the first and second sides of the elongate slotted body member about the underside of the crutch arm piece proximate the second end of the crutch pad, thereby preventing the crutch pad cover of the present invention from being accidentally disengaged from the crutch pad. In the preferred embodiment of the invention, a tab/aperture flap system is utilized to secure the first and second sides of the body member together on the underside of the crutch arm piece. In particular, the first side of the body member includes a flap having an outwardly protruding coupling element on an outwardly facing side thereof and the second side of the body member includes a flap having an aperture therethrough which is adapted to receive the outwardly protruding coupling element therein. The flaps on the first and second sides of the body member may be formed integrally therewith or may be subsequently secured thereto. In an alternate embodiment of the invention, the flap securing system may utilize loop/hook-type material as a fastening agent. In particular, one of the flaps may be covered on at least one side with a loop-type material and the other of the flaps may be correspondingly covered on at least one side with a hook-type material which is adapted to be removably fastened to the loop-type material.

The elongate slotted body member is preferably formed out of a waterproof, nonporous and stain resistant material having a coefficient of friction lower than the coefficient of friction of the foam rubber commonly utilized in the formation of crutch pads. In particular, a moldable material formed from polyethylene, polypropylene, polyvinyl or the like may be utilized in the construction of the body member. Of course, other synthetic and natural materials having the above-described characteristics may also be utilized if desired.

The material characteristics of the low friction crutch pad cover overcome many of the above-described disadvantages associated with the commonly available crutch pads formed out of foam rubber or other similar materials. For example, the low coefficient of friction of the crutch pad cover body member improves the operational comfort level of a crutch pad when secured thereover by allowing the underarm clothing area of a crutch user to easily slide over the body member, thereby reducing the frictional damage to the clothing, decreasing any resulting wrinkling of the clothing and/or reducing the pinching, irritation or chafing of the underlying skin which is commonly caused by foam rubber crutch pads. In addition, the waterproof, nonporous and stain resistant characteristics of the present invention protect both the crutch pad cover and the underlying foam rubber crutch pad from moisture, underarm perspiration, dirt, odors and/or other detrimental influences, thereby prolonging their operational life span and maintaining the appearance thereof.

A plurality of outwardly projecting stop members positioned proximate the first and second end portions of the elongate slotted body member may be provided to prevent the underarm area of a crutch user from slipping off the low friction crutch pad of the present invention and to control the position of the underarm area thereon. In particular, the stop members, which are adapted to substantially encircle the first and second sides of the body member, may be formed unitarily with the body member or may be separately attached thereto. The stop members may be formed out of the same material utilized in the construction of the body member or out of any other suitable material. To facilitate the operation of the stop members, the upper surface thereof may include striations or may be covered with a material having a high coefficient of friction.

In the preferred embodiment of the invention, the low friction crutch pad cover is adapted to fit snugly over an existing crutch pad. Depending upon the operational strength and durability of the material which is utilized during the formation of the body member, the thickness of the crutch pad cover may vary from a few mils to a quarter inch or more. If it is desired to increase the cushioning properties of a crutch pad, the crutch pad cover of the present invention may include a layer of additional padding therein.

DETAILED DESCRIPTION OF THE INVENTION

Referring now specifically to the drawings, there is illustrated the low friction crutch pad cover of the present invention, generally designated as 10.

Figure 3:
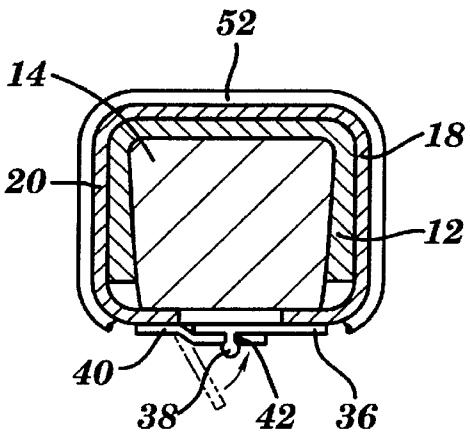
FIG. 3 is a cross-sectional view of the low friction crutch pad cover taken along line 3—3 of FIG. 2.
Figure 1:
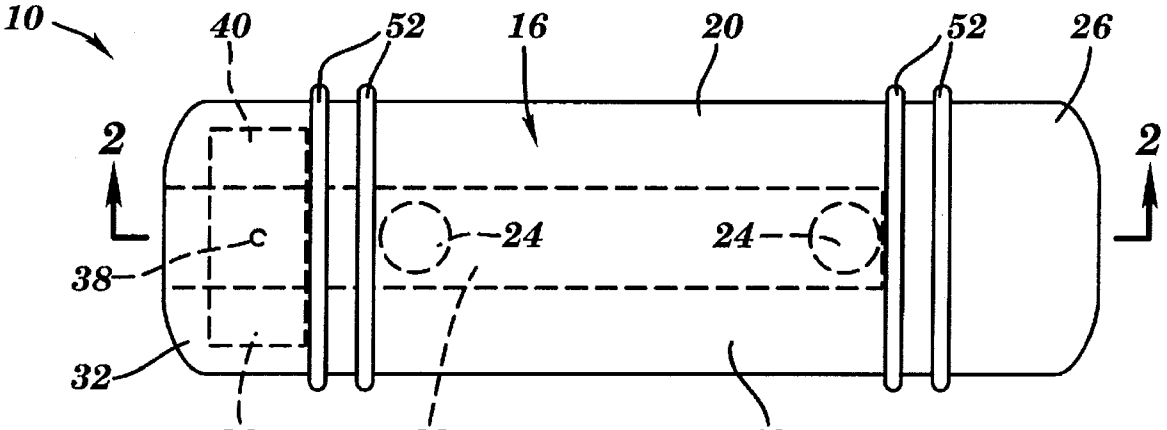
FIG. 1 is a plan view of a low friction crutch pad cover mounted on a crutch pad according to the preferred embodiment of the invention with the crutch bows, flap securing system and crutch pad mounting aperture illustrated in phantom.
Figure 2:
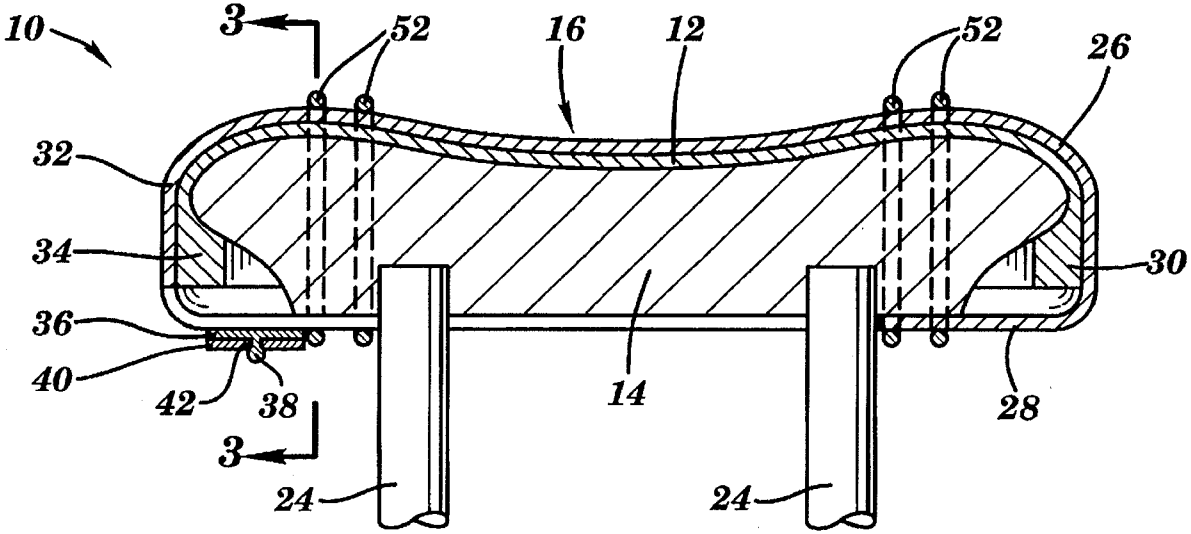
FIG. 2 is a cross-sectional view of the low friction crutch pad cover taken along line 2—2 of FIG. 1.

The preferred embodiment of the present invention is illustrated in detail in FIGS. 1–3. In particular, the crutch pad cover 10 is adapted to be placed over a foam rubber or other type crutch pad 12 that has been secured over a crutch arm piece 14.

The crutch pad cover 10 includes an elongate body member, generally indicated as 16, having a first side 18 and a second side 20 which are mutually adapted to partially encircle the periphery of the crutch pad 12 along a portion of its length, thereby forming a slotted crutch pad mounting aperture 22 for receiving the crutch pad therein, with the crutch bows 24 extending downward therethrough. The body member 16 further includes a first end portion 26 having an inwardly flanged end section 28 which forms a cavity for receiving a first end 30 of the crutch pad 12 therein and a downwardly directed second end portion 32 for covering a second end 34 of the crutch pad.

To prevent the crutch pad cover 10 from being accidentally removed from the crutch pad 12, a flap securing system is provided for fastening the first and second sides 18, 20 of the body member 16 about the underside of the crutch arm piece 14 proximate the second end 34 of the crutch pad. In particular, the first side 18 of the body member includes a flap 36 having an outwardly protruding coupling element 38 thereon. Analogously, the second side 20 of the body member includes a flap 40 having an aperture 42 therethrough for receiving the coupling element 38 therein.

Figure 4:
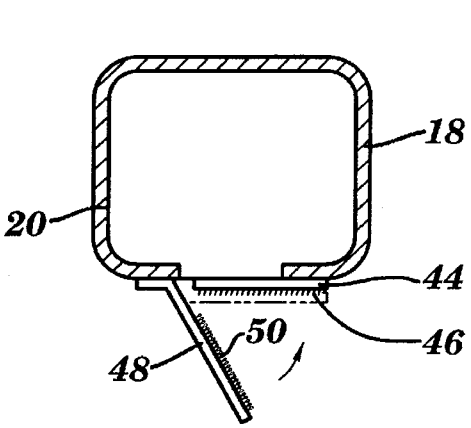
FIG. 4 is a cross-sectional view of an alternate embodiment of the invention including a hook and loop-type flap securing system.

An alternate embodiment of the flap system is illustrated in FIG. 4. In this embodiment, the first side 18 of the body member includes a flap 44 which is covered on an outwardly facing side thereof with a hook-type material 46, and the second side 20 of the body member includes a flap 48 covered on an inwardly facing side thereof with a loop-type material 50 which is adapted to be removably securable to the hook-type material 46.

A plurality of outwardly projecting stop members 52 may be provided to prevent the underarm area of a crutch user from slipping off the low friction crutch pad cover 10 of the present invention and to control the relative position of the underarm area thereon. In particular, the stop members 52 are adapted to partially encircle the first and second sides 18, 20 of the body member 16. Preferably, at least one of the stop members 52 is positioned proximate the first and second end portions 26, 32 of the body member 16.

The foregoing description of the preferred embodiments of the invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

I claim:

1. A crutch pad cover comprising:

an elongate slotted body member for receiving a crutch pad therein, said body member including first and second sides which are adapted to partially encircle said crutch pad thereby forming a slot, and first and second end portions, said first end portion including an inwardly directed flanged section, said first and second sides and said inwardly directed flanged section forming a cavity for receiving and securing a first end of said crutch pad therein, said first and second sides and said second end portion forming a continuous sheath adapted to cover a second end of said crutch pad; and means for securing said first and second sides of said body member about said crutch pad proximate the second end thereof.

2. The crutch pad cover according to claim 1 wherein said securing means further includes:

first and second flap members; and means for fastening said first and second flap members together.

3. The crutch pad cover according to claim 2 wherein said fastening means further includes:

an outwardly protruding coupling element on said first flap member; and an aperture in said second flap member for receiving said coupling element therein.

4. The crutch pad cover according to claim 2 wherein said fastening means further includes:

a plurality of loop-type connecting elements on a first side of said first flap member; and a plurality of hook-type connecting elements on a second, oppositely directed side of said second flap member.

5. The crutch pad cover according to claim 1 wherein said elongate slotted body member includes an outer surface having a coefficient of friction lower than the coefficient of friction of the material forming the outer surface of said crutch pad.

6. The crutch pad cover according to claim 1 wherein said elongate slotted body member includes an outer surface which is substantially waterproof.

7. The crutch pad cover according to claim 1 wherein said elongate slotted body member includes an outer surface which is substantially nonporous.

8. The crutch pad cover according to claim 1 wherein said elongate slotted body member includes an outer surface which is substantially stain proof.

9. The crutch pad cover according to claim 1 wherein said elongate slotted body member includes a plurality of outwardly projecting stop members thereon and formed unitarily therewith, for controlling the position of a covered crutch pad relative to the underarm area of a user.

10. The crutch pad cover according to claim 9 wherein at least one of said outwardly projecting stop members is positioned proximate said first end portion of said body member and at least one of said outwardly projecting stop members is positioned proximate said second end portion of said body member.

11. The crutch pad cover according to claim 9 wherein said stop members are adapted to substantially encircle the first and second sides of said body member.

* * * * *